US011198308B2

(12) United States Patent
Yoshinuma

(10) Patent No.: US 11,198,308 B2
(45) Date of Patent: Dec. 14, 2021

(54) HEATING DEVICE AND PRINTER

(71) Applicant: Toshihiro Yoshinuma, Kanagawa (JP)

(72) Inventor: Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/933,803

(22) Filed: Jul. 20, 2020

(65) Prior Publication Data

US 2021/0053342 A1 Feb. 25, 2021

(30) Foreign Application Priority Data

Aug. 21, 2019 (JP) ..... JP2019-151017

(51) Int. Cl.
*B41J 11/00* (2006.01)

(52) U.S. Cl.
CPC ..... *B41J 11/0024* (2021.01); *B41J 11/0022* (2021.01)

(58) Field of Classification Search
CPC ..... B41J 11/0024; B41J 11/0022
See application file for complete search history.

(56) References Cited

U.S. PATENT DOCUMENTS

2006/0103695 A1* 5/2006 Young ..... B41J 2/14153 347/58
2016/0273832 A1 9/2016 Asada et al.
2017/0090361 A1 3/2017 Kuwana et al.
2017/0120625 A1 5/2017 Yoshinuma
2017/0266990 A1 9/2017 Yoshinuma et al.
2017/0266991 A1 9/2017 Onodera et al.
2017/0334217 A1 11/2017 Yoshinuma et al.
2018/0009237 A1 1/2018 Sakamoto et al.
2020/0207120 A1 7/2020 Yoshinuma

FOREIGN PATENT DOCUMENTS

JP 2017-065126 4/2017

* cited by examiner

*Primary Examiner* — Justin Seo
(74) *Attorney, Agent, or Firm* — Duft & Bornsen, PC

(57) ABSTRACT

A heating device includes a heater to heat an object to be heated, a temperature detector to detect a surface temperature of the heater, a power calculator to calculate a power consumption of the heater, an abnormality detector to detect an abnormality of the temperature detector, and circuitry to cause the heater to increase the surface temperature of the heater from a first temperature to a second temperature higher than the first temperature; cause the power calculator to calculate the power consumption of the heater increased to the second temperature; cause the abnormality detector to compare the power consumption calculated by the power calculator and a predetermined threshold value; and cause the abnormality detector to determine that the temperature detector is abnormal when the power consumption calculated by the power calculator is equal to or larger than the predetermined threshold value.

6 Claims, 11 Drawing Sheets

| | | STAIN ERROR | | | |
|---|---|---|---|---|---|
| | | 0% | 2% | 5% | 10% |
| TEMPER-ATURE [°C] | 20 | 0.5 | 0.49 | 0.475 | 0.45 |
| | 100 | 2.5 | 2.45 | 2.375 | 2.25 |
| | 150 | 3.75 | 3.675 | 3.5625 | 3.375 |

[V]

| | | STAIN ERROR | | | |
|---|---|---|---|---|---|
| | | 0% | 2% | 5% | 10% |
| TEMPER-ATURE [°C] | 20 | 20 | 19.6 | 19 | 18 |
| | 100 | 100 | 98 | 95 | 90 |
| | 150 | 150 | 147 | 142.5 | 135 |

FIG. 14

| HEATING ROLLER | POWER CONSUMPTION | CONTACTLESS DETECTOR | |
|---|---|---|---|
| | | 25A | 25B |
| 11A | POWER STANDARD | STANDARD:0 | 1 |
| 11B | 1% | STANDARD:0 | 0 |
| 11C | 2% | STANDARD:0 | 0 |
| : | : | : | : |
| 11K | −1% | | |
| 11J | −2% | STANDARD:0 | 1 |

[°C]

FIG. 15

| | POWER CONSUMPTION | | | CONTACTLESS DETECTOR | | |
|---|---|---|---|---|---|---|
| | STANDARD | RESULT | COMPARISON TEST | 25A | 25B | COMPARISON TEST |
| 11A | POWER STANDARD | – | – | STANDARD:0 | 1 | NORMAL |
| 11B | 1% | 2% | NORMAL | STANDARD:0 | 0 | NORMAL |
| 11C | 2% | 1% | NORMAL | STANDARD:0 | 0 | NORMAL |
| ⋮ | ⋮ | ⋮ | ⋮ | ⋮ | ⋮ | ⋮ |
| 11K | −2% | −5% | NORMAL | STANDARD:0 | 0 | NORMAL |
| 11J | −2% | 5% | ABNORMAL | STANDARD:0 | 10 | ABNORMAL |

[°C]

HEATING DEVICE AND PRINTER

CROSS-REFERENCE TO RELATED APPLICATION

This patent application is based on and claims priority pursuant to 35 U.S.C. § 119(a) to Japanese Patent Application No. 2019-151017, filed on Aug. 21, 2019, in the Japan Patent Office, the entire disclosures of which is hereby incorporated by reference herein.

BACKGROUND

Technical Field

Aspects of the present disclosure relate to a heating device and a printer.

Related Art

A printer to apply a liquid onto a sheet to print includes a dryer including a heating device that brings a heater such as a heating roller into contact with a sheet to be dried.

A printer includes a plurality of contactless-type temperature detectors to detect temperature of a heating member and one contact-type temperature detector to detect temperature of the heating member. The printer compares a detection result of the plurality of contactless-type temperature detectors and a detection result of the contact-type temperature detector to determine abnormality of the plurality of contactless-type temperature detectors.

SUMMARY

In an aspect of this disclosure, a liquid discharge head includes a heating device including a heater to heat an object to be heated, a temperature detector to detect a surface temperature of the heater, a power calculator to calculate a power consumption of the heater, an abnormality detector to detect an abnormality of the temperature detector, and circuitry to cause the heater to increase the surface temperature of the heater from a first temperature to a second temperature higher than the first temperature; cause the power calculator to calculate the power consumption of the heater increased to the second temperature, cause the abnormality detector to compare the power consumption calculated by the power calculator and a predetermined threshold value, and cause the abnormality detector to determine that the temperature detector is abnormal when the power consumption calculated by the power calculator is equal to or larger than the predetermined threshold value.

In another aspect of this disclosure, a heating device includes a heater to heat an object to be heated, a temperature detector to detect a surface temperature of the heater, a power calculator to calculate a power consumption of the heater, an abnormality detector to detect an abnormality of the temperature detector, and circuitry. The circuitry apples a predetermined power to the heater to cause the heater to increase the surface temperature of the heater from a first temperature to a second temperature higher than the first temperature, causes the temperature detector to detect the surface temperature of the heater increased to the second temperature, causes the abnormality detector to compare the surface temperature of the heater detected by the temperature detector with the second temperature, and causes the abnormality detector to determine that the temperature detector is abnormal when the surface temperature of the heater detected by the temperature detector is equal to or lower than the second temperature.

In still another aspect of this disclosure, a heating device includes a plurality of heaters to heat an object to be heated, a plurality of temperature detectors to detects surface temperatures of the plurality of heaters, a power calculator to calculate a power consumption of each of the plurality of heaters, an abnormality detector to detect an abnormality of each of the plurality of temperature detectors, and circuitry configured to cause the abnormality detector to calculate a difference between the power consumption of one of the plurality of heaters determined in advance and the power consumption of another of the plurality of heaters, compare the difference with a threshold value, and determine that one of the plurality of temperature detectors that detects a surface temperature of said another of the plurality of heaters is abnormal when the difference is equal to or larger than the threshold vale.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein:

FIG. 14 is a table illustrating a fifth embodiment of the present disclosure.

FIG. 15 is a table illustrating an example of a comparison determination used for describing an effect of the fifth embodiment.

Figure 1:
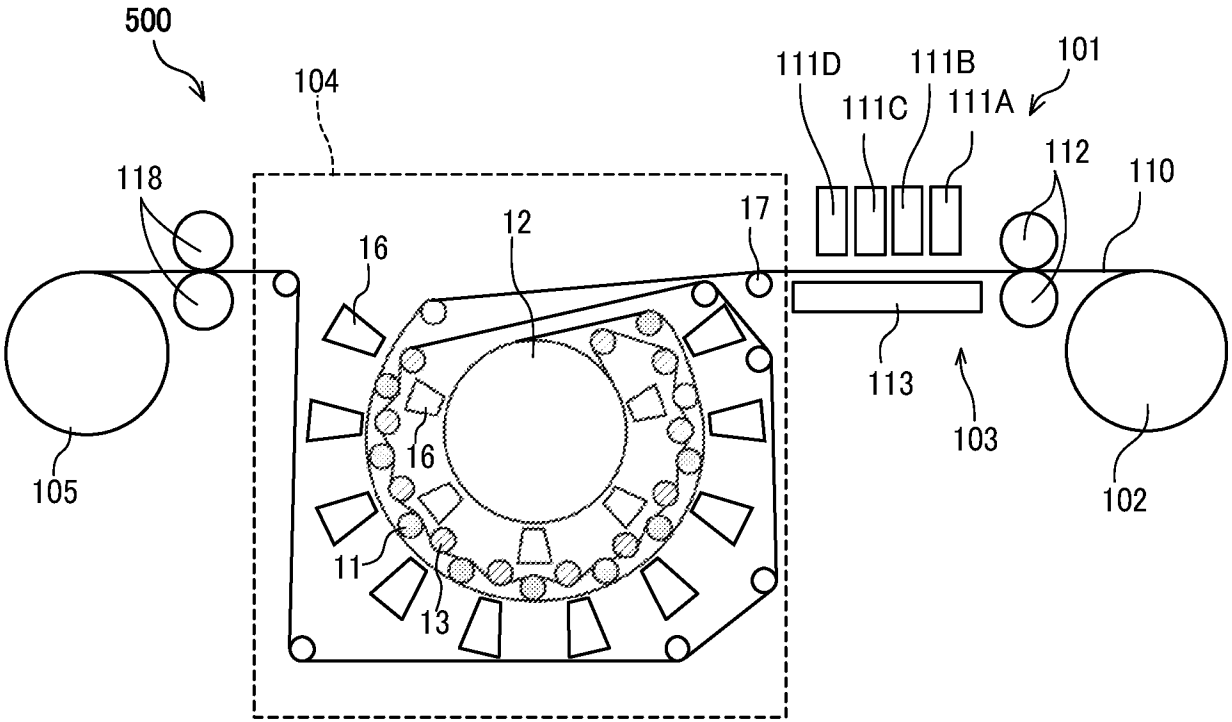
FIG. 1 is a schematic side view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below.

First, a printer 500 according to a first embodiment of the present disclosure is described with reference to FIG. 1. FIG. 1 is a schematic cross-sectional side view of the printer 500.

The printer 500 is an inkjet recording apparatus, and includes a liquid application device 101 including a liquid discharge head, which is a liquid applicator, to discharge and apply ink, which is a liquid of desired color, onto a web 110 such as a web as a sheet material that is an object to be printed (object to be heated or object to be dried).

The liquid application device 101 includes, for example, full-line heads 111A, 111B, 111C, and 111D for four colors arranged from an upstream side (right side in FIG. 1) in a conveyance direction (leftward direction in FIG. 1) of the web 110. The heads 111A, 111B, 111C, and 111D respectively apply liquids of black K, cyan C, magenta M, and yellow Y onto the web 110. Note that number and types of color are not limited to the above-described four colors of K, C, M, and Y and may be any other suitable number and types.

The web 110 is fed from a feeding roller 102, is sent onto a conveyance guide 113 by conveyance rollers 112 of a conveyance device 103, and is guided and conveyed (moved) by the conveyance guide 113. The conveyance guide 113 is disposed to face the liquid application device 101.

The web 110 to which the liquid has been applied by the liquid application device 101 passes through a dryer 104 (heating device) including a web loader. A pair of sheet ejection rollers 118 further conveys the web 110, and a winding roller 105 winds the web 110.

Figure 2:
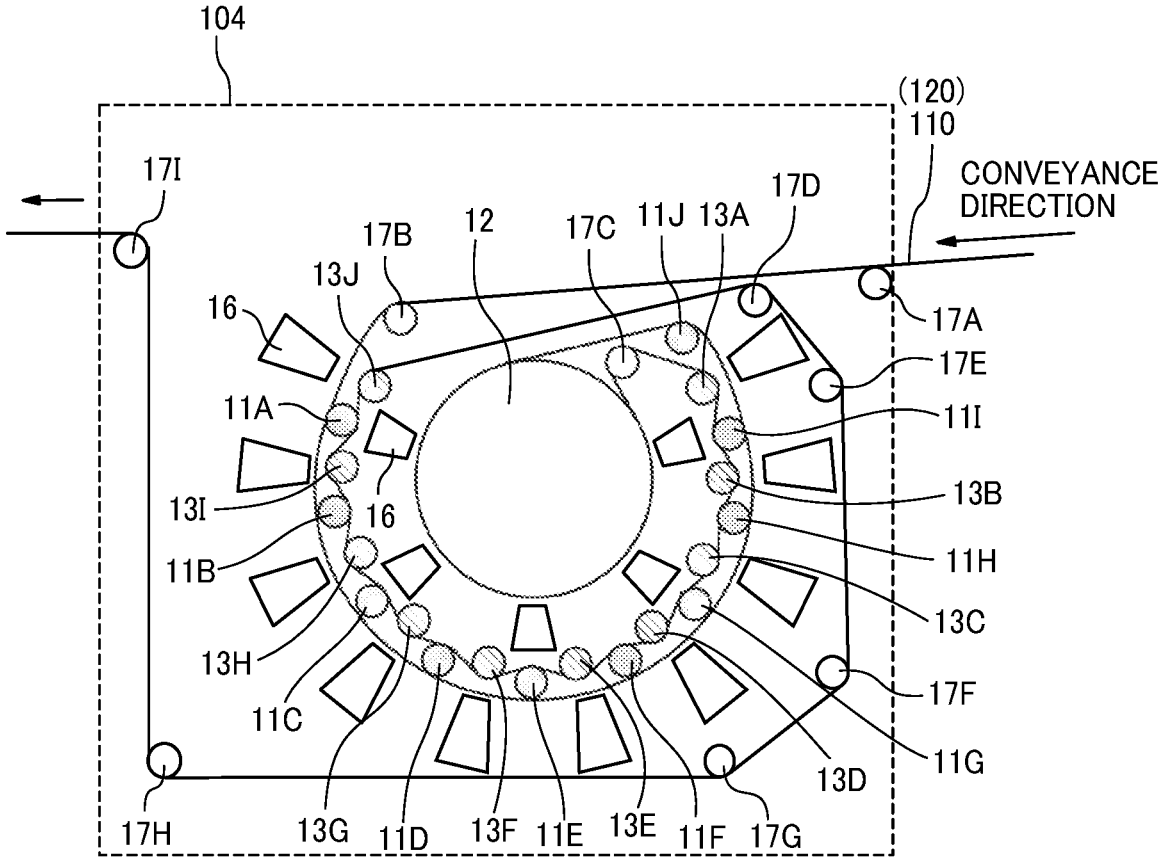
FIG. 2 is enlarged cross-sectional view of a dryer according to the first embodiment of the present disclosure.

Next, the dryer 104 according to a first embodiment of the present disclosure is described with reference to FIG. 2. FIG. 2 is an enlarged schematic cross-sectional view of the dryer 104.

The dryer 104 includes heating rollers 11 (11A to 11J), which are ten rotating bodies, and a heating drum 12. The heating rollers 11 and the heating drum 12 constitute a contact heating device to contact and heat the web 110. Further, the dryer 104 includes ten guide rollers 13 (13A to 13J) to guide the web 110 so that the web 110 is pressed against the heating rollers 11A to 11I. The heating rollers 11 and the heating drum 12 are rotating bodies that guide and convey the web 110. The heating rollers 11 and the heating drum 12 are also heating rotating bodies. The dryer 104 is also referred to as a "heating device."

The dryer 104 further includes two guide rollers 17A and 17B to guide the web 110 to the heating roller 11A, one guide roller 17C to wind the web 110 around the heating drum 12, and five guide rollers 17D to 17I that guide the web 110 exiting from the heating roller 11A outside the dryer 104 (apparatus body of the dryer 104).

The guide rollers 17A to 17I may also be collectively referred to as "the guide roller 17".

The plurality of heating rollers 11A to 11J is in a substantially arc-shaped arrangement around the heating drum 12. Note that the diameters of the heating rollers 11A to 11J can be identical to or different from each other. Further, the guide rollers 13A to 13J are disposed between the adjacent heating rollers 11.

The plurality of heating rollers 11, the heating drum 12, and the plurality of guide rollers 13 constitute a heating conveyance path (conveyance path) to heat the web 110. The web 110 is conveyed to the plurality of the heating rollers 11 upstream from the heating drum 12 while the web 110 contacts an outer circumference of the plurality of the heating rollers 11 arranged in an arc-shape. The "outer circumferential of the plurality of heating rollers 11" represents an outer circumference of the plurality of heating rollers 11 that contacts the web 110 on the conveyance path disposed outside the plurality of heating rollers 11 with respect the center of the dryer 104.

Then, the web 110 is conveyed to the heating drum 12 and is conveyed again to the plurality of the heating rollers 11 while the web 110 contacts an inner circumference of the plurality of the heating rollers 11 by the plurality of guide rollers 13. The "inner circumferential of the plurality of heating rollers 11" represents the inner circumference of the plurality of heating rollers 11 that contacts the web 110 on the conveyance path disposed interior of the plurality of heating rollers 11 with respect the center of the dryer 104.

Thus, the same plurality of heating rollers 11 of the dryer 104 according to the present embodiment contacts and heats the web 110 from different directions, that is, a direction from a liquid application surface and a direction from a surface opposite the liquid application surface of the web 110.

The dryer 104 includes a plurality of hot air fans 16 as a contactless heater to heat the web 110 from the liquid application surface side on the outer circumference side of the arrangement of the plurality of heating rollers 11. The dryer 104 also includes a plurality of hot air fans 16 around the heating drum 12.

With the above-described configuration, the dryer 104 heats the web 110 with the plurality of heating rollers 11 contacting the surface opposite the liquid application surface of the web 110 while blowing hot air toward the liquid application surface of the web 110 with the hot air fans 16 to heat the liquid application surface of the web 110 to dry the web 110.

Then, the heating drum 12 arranged interior of the plurality of heating rollers 11 contacts and heats the surface opposite the liquid application surface of the web 110 while blowing the hot air onto the liquid application surface of the web 110 with the hot air fans 16 to heat the liquid application surface of the web 110.

Then, the dryer 104 heats the surface opposite to the liquid application surface of the web 110 with the plurality of heating rollers 11 again while the guide rollers 13 contacting the liquid application surface of the web 110 to dry the liquid applied on the web 110. Then, the dryer 104 transfers the web 110 to a next stage with the guide rollers 17D to 17I.

The dryer 104 includes a conveyance path 120 of the web 110. The conveyance path 120 is indicated by a path of the web 110. To simplify the drawing, the web 110 and the conveyance path 120 are illustrated by the same line. The plurality of heating rollers 11 and the plurality of guide rollers 13 configure a heating conveyance path meandering in the dryer 104.

Figure 3:
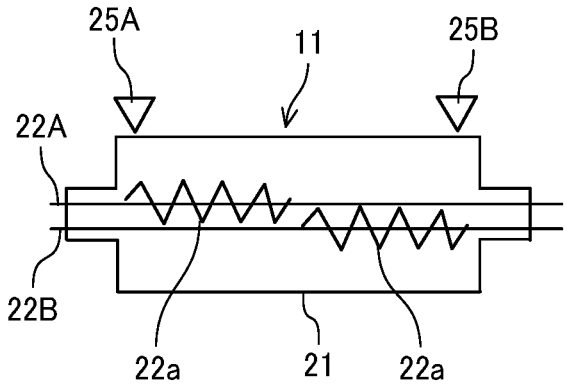
FIG. 3 is a schematic cross-sectional view of an example of a heating roller.

Next, a configuration of the heating roller 11 is described with reference to FIG. 3. FIG. 3 is a schematic cross-sectional view of an example of the heating roller 11.

The heating roller 11 includes two heater lamps 22 (22A and 22B) as heat sources in a hollow roller body 21. Each of the heater lamps 22A and 22B includes a heater light emitter 22*a*.

The heating roller 11 further includes temperature sensors 25 (25A and 25B) as contactless-type temperature detectors to detect surface temperature of the heating roller 11 without contacting the heating roller 11. Hereinafter, the "contactless-type temperature detector" is simply referred to as the "contactless temperature detector."

Next, a different example of the heating roller 11 including the temperature sensors 25 (temperature detectors) is described with reference to FIGS. 4A and 4B, and FIGS. 5A and 5B.

Figure 4A:
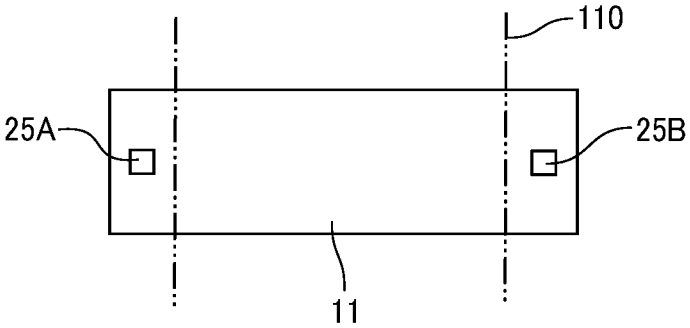
FIG. 4A is a schematic front view of a first example of the heating roller including temperature sensors (temperature detectors)

FIG. 4A is a schematic front view of a first example of the heating roller 11 including the temperature sensors 25 (temperature detectors).

Figure 4B:
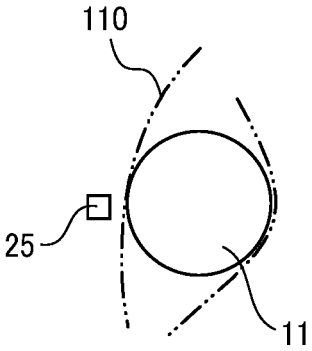
FIG. 4B is a schematic side view of the heating roller including the temperature sensors of FIG. 4A.
Figure 5A:
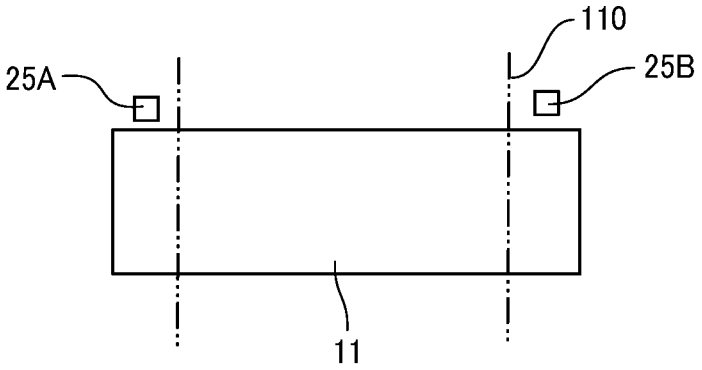
FIG. 5A is a schematic front view of a second example of the heating roller including the temperature sensors (temperature detectors)

FIG. 4B is a schematic side view of the heating roller 11 including the temperature sensor 25 of FIG. 4A. FIG. 5A is a schematic front view of a second example of the heating roller 11 including the temperature sensors 25 (temperature detectors).

Figure 5B:
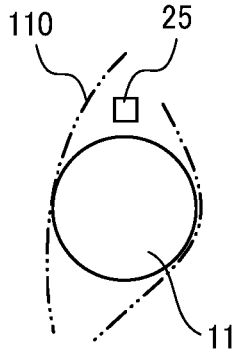
FIG. 5B is a schematic side view of the heating roller including the temperature sensor of FIG. 5A.

FIG. 5B is a schematic side view of the heating roller 11 including the temperature sensor 25 of FIG. 5A. Thus, FIGS. 4A and 5A are schematic front views of the heating roller 11. FIGS. 4B and 5B are schematic side views of the heating roller 11.

The first example of the heating roller 11 illustrated in FIG. 4A includes two temperature sensors 25 (25A and 25B) arranged at both ends of the heating roller 11 in an axial direction of the heating roller 11. More specifically, the two temperature sensors 25A and 25B are arranged outside a contact area (central area) of the heating roller 11 in which the heating roller 11 contacts the web 110.

As illustrated in FIG. 4B, the two temperature sensors 25 (25A and 25B) are arranged at positions sandwiching the conveyance path of the web 110 between the temperature sensors 25 and the heating roller 11 in a radial direction of the heating roller 11. In other words, the two temperature sensors 25 oppose to (face) the heating roller 11 such that the web 110 passes through a conveyance path formed between the temperature sensors 25 and the heating roller 11.

Thus, the temperature sensors 25 can detect a surface temperature of an area of the heating roller 11 in which the heating roller 11 does not contact the web 110.

The second example of the heating roller 11 illustrated in FIG. 5A includes two temperature sensors 25 (25A and 25B) arranged at both ends of the heating roller 11 in the axial direction of the heating roller 11. More specifically, the two temperature sensors 25A and 25B are arranged outside the contact area (central area) of the heating roller 11 in which the heating roller 11 contacts the web 110.

As illustrated in FIG. 5B, the two temperature sensors 25 (25A and 25B) are arranged at positions that does not sandwich the conveyance path of the web 110 between the temperature sensors 25 and the heating roller 11 in the radial direction of the heating roller 11. In other words, the two temperature sensors 25 are arranged above the heating roller between a forward path (left path) and a return path (left path) of the web 110 in a cross-sectional direction (radial direction) of the heating roller 11 such that the web 110 does not pass through a conveyance path formed between the temperature sensors 25 and the heating roller 11 (see FIG. 5B).

Thus, the temperature sensors 25 can reliably detect the surface temperature of an area of the heating roller 11 to which the web 110 has not been contacted even if the web 110 passes through an area of the heating roller 11, a position of which is deviated in an axial position of the web 110 with respect to the heating roller 11.

Figure 6:
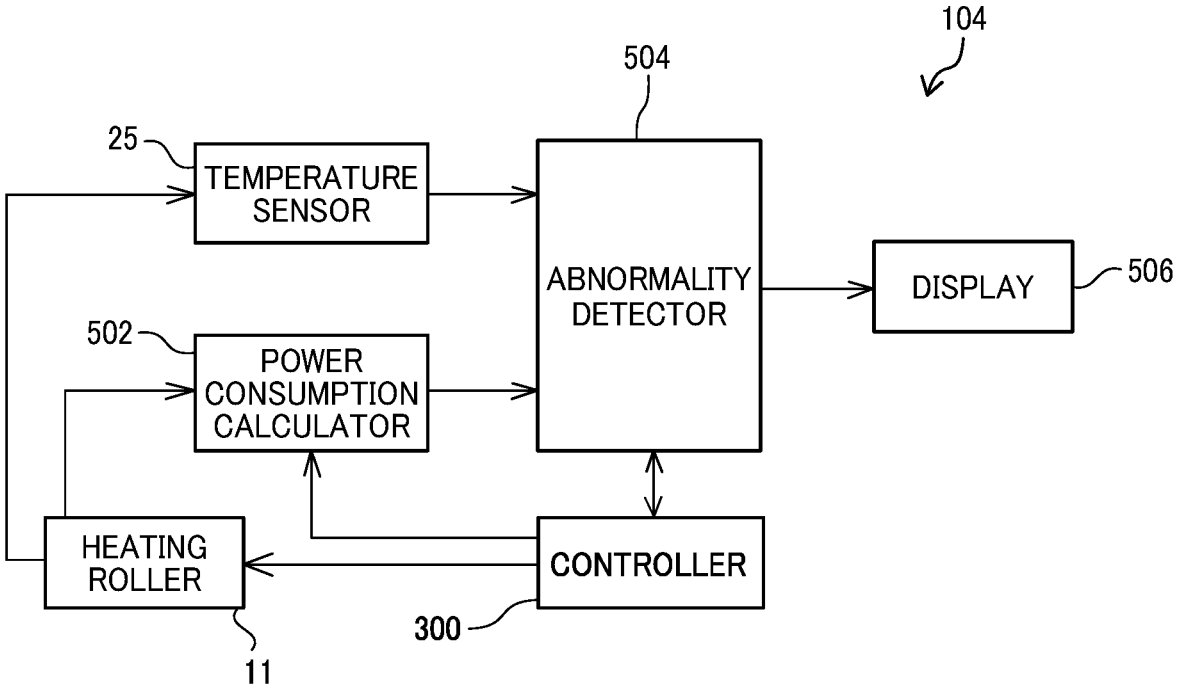
FIG. 6 is a block diagram of a part related to an abnormality detection of the temperature detector.

Next, the part related to an abnormality detection of the temperature sensor 25 is described with reference to a block diagram of FIG. 6.

As described above, the temperature sensor 25 (temperature detector) detects the surface temperature of the heating roller 11 without contacting the heating roller 11. That is, the temperature sensors 25 detect the surface temperature of the heating roller 11 in a contactless manner.

The dryer 104 includes a controller 300 (circuitry) to control a power consumption calculator 502, an abnormality detector 504, and the heating rollers 11 (heaters). The abnormality detector 504 calculates a power consumption of the heating roller 11. The power consumption calculator 502 multiples time by a current duty (current value) to calculate the power consumption of the heating roller 11. The power consumption calculator 502 is also simply referred to as a "power calculator."

The power consumption calculator 502 may also detect an effective power applied to the heater lamp 22 (heat sources) of the heating roller 11 and multiply the effective power by the time to calculate the power consumption of the heating roller 11.

Thus, the power consumption calculator 502 (power calculator) multiply the time and the effective power applied to the heating roller 11 (heater), while the controller 300 (circuitry) increases the surface temperature of the heating roller 11 (heater), to calculate the power consumption of the heating roller 11 (heater).

The abnormality detector 504 detects an abnormality of the temperature sensors 25 based on a detection result (detected temperature) from the temperature sensors 25 and a calculation result from the power consumption calculator 502.

When the abnormality detector 504 detects an abnormality in the temperature sensors 25, the abnormality detector 504 outputs information related to an abnormality detection to the display 506 such as an operation panel. For example, the abnormality detector 504 outputs information that prompts the user to clean the temperature sensors 25.

Figures 7A, 7B, 8:
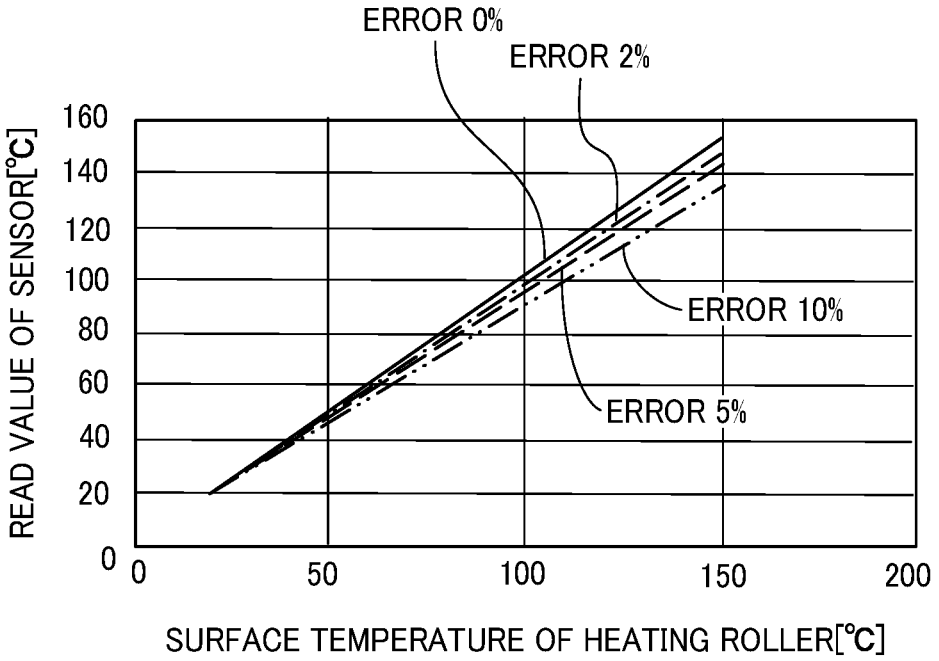
FIG. 7A is a table illustrating an example of a relation between an analog output of the contactless temperature detector (temperature sensor) and a stain error (dirt error)
FIG. 7B is a table illustrating an example of a relation between a read value (detection result) of the contactless temperature detector (temperature sensor) and the stain error (dirt error)
FIG. 8 is a graph illustrating an example of a relation between a surface temperature of the heating roller, a read value of the contactless temperature detector (temperature sensor), and the stain error (dirt error)

Next, output characteristics of the temperature detector as the temperature sensor 25 is described with reference to FIGS. 7A and 7B, and FIG. 8. FIG. 7A is a table illustrating an example of a relation between an analog output of the contactless temperature detector (temperature sensor 25) and a stain error (dirt error) due to a dirt on the lens of the temperature sensor 25.

FIG. 7B is a table illustrating an example of a relation between a read value (detection result) of the contactless temperature detector (temperature sensor 25) and the stain error (dirt error). The read values (detection results) of the contactless temperature detector in FIG. 7B are obtained by converting the analog outputs of the contactless temperature detector in FIG. 7A.

FIG. 8 is a graph illustrating an example of a relation between the surface temperature of the heating roller 11, a read value of the contactless temperature detector (temperature sensor 25), and the stain error (dirt error).

The heating roller 11 uses a thermopile sensor (infrared sensor) as a contactless temperature detector that configures the temperature sensor 25. The thermopile sensor converts infrared light collected on a lens into an analog signal (converts light to a voltage) and converts the voltage into a temperature value by analog to digital (A/D) conversion. Here, the "detected temperature" is also referred as the "detection result". Thus, the analog output (see FIG. 7A) increases with an increase in the read value (see FIG. 7B) of the contactless temperature detector.

Thus, if the lens is stained (dirty), an amount of infrared light entering the lens decreases. Thus, the analog output (voltage) decreases so that the detected temperature becomes lower than a correct temperature. Thus, the stain error (dirt error) occurs between the detected temperature and an actual temperature (correct temperature).

As illustrated in FIGS. 7A and 7B and FIG. 8, when the analog output is low (0.5 V, for example) and the detected temperature is low (about 20° C.), the stain error (dirt error) between the detected temperature and the correct temperature is small (0%, for example). However, the stain error (dirt error) increases with an increase in the analog output (see FIG. 7A) of the contactless temperature detector. As illustrated in FIGS. 7B and 8, the read value of the temperature is 150° C. when the stain error is 0% and the surface temperature is 150° C. The read value of the temperature is 135° C. when the stain error is 10% and the surface temperature is 150° C.

Thus, the difference between the read value when the stain error is 0% and the read value when the stain error is 10% is 15° C. when the surface temperature of the heating roller 11 is high as 150° C. Further, the read value of the temperature is 20° C. when the stain error is 0% and the surface temperature is 20° C. The read value of the temperature is 18° C. when the stain error is 10% and the surface temperature is 20° C.

Thus, the difference between the read value when the stain error is 0% and the read value when the stain error is 10% is 2° C. when the surface temperature of the heating roller 11 is low as 20° C. Therefore, the difference of the read value of the temperatures between the two stain errors (0% and 10%) increases with an increase in the surface temperature of the heating roller 11 (analog output).

Therefore, when the stain error (dirt error) is large, that is when the contactless temperature detector is stained (dirty), the dryer 104 may excessively increase the temperature of the heating roller 11 to increase the surface temperature of the heating roller 11 from 20° C. to 150° C., for example.

Thus, when the lens of the contactless temperature detector is stained (dirty), that is, when the stain error (dirt error) occurs, the power consumption becomes larger than the power consumption when the lens of the contact temperature detector is not stained (when the stain error does not occur). Thus, it is possible to calculate the power consumption to determine whether the contactless temperature detector is stained (dirty), that is, determine whether an abnormality of the contact temperature detector occurs.

Figure 9:
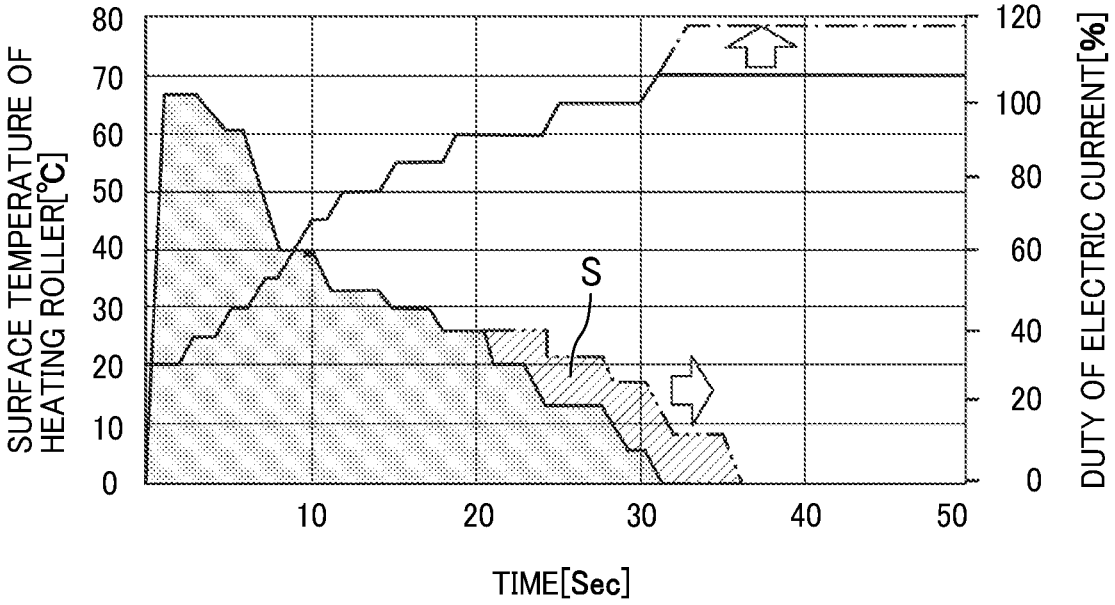
FIG. 9 is a graph illustrating an example of a relation between a duty of an electric current applied to the heating roller, time, and a change in the surface temperature of the heating roller.

Next, calculation of the power consumption is described with reference to FIG. 9. FIG. 9 is a graph illustrating an example of a relation between a duty of an electric current (current duty) applied to the heating roller 11, time, and a change in the surface temperature of the heating roller 11. Hereinafter, the "electric current" is simply referred to as the "current."

In FIG. 9, one of (right side of) vertical axes represents a duty of electric current (duty [%]), a horizontal axis represents time (sec), and another of (left side of) the vertical axes represents changes in the surface temperature of the heating roller 11.

The power consumption can be calculated by an area of time and a current value. The power consumption is calculated for each of the heating roller 11 one by one.

When the surface temperature of the heating roller 11 is raised from 20° C. to 70° C. and the temperature sensor 25 is normal, the duty of the current and the surface temperature change as illustrated by a solid line in FIG. 9. However, when the temperature sensor 25 is stained (dirty), the detected temperature of the temperature sensor 25 is lower than the correct temperature so that the duty of the current and the surface temperature of the heating roller 11 change as illustrated by an imaginary line in FIG. 9.

In the example in FIG. 9, the temperature sensor 25 detects the surface temperature of the heating rollers 11 as 70° C. However, the temperature sensor 25 is stained (dirty) so that the surface temperature of the heating roller 11 is actually raised to about 80 (see alternate long and short dashed line in top right of FIG. 9). Thus, the power consumption increases by an area S calculated by multiplying the time and the current value.

Figure 10:
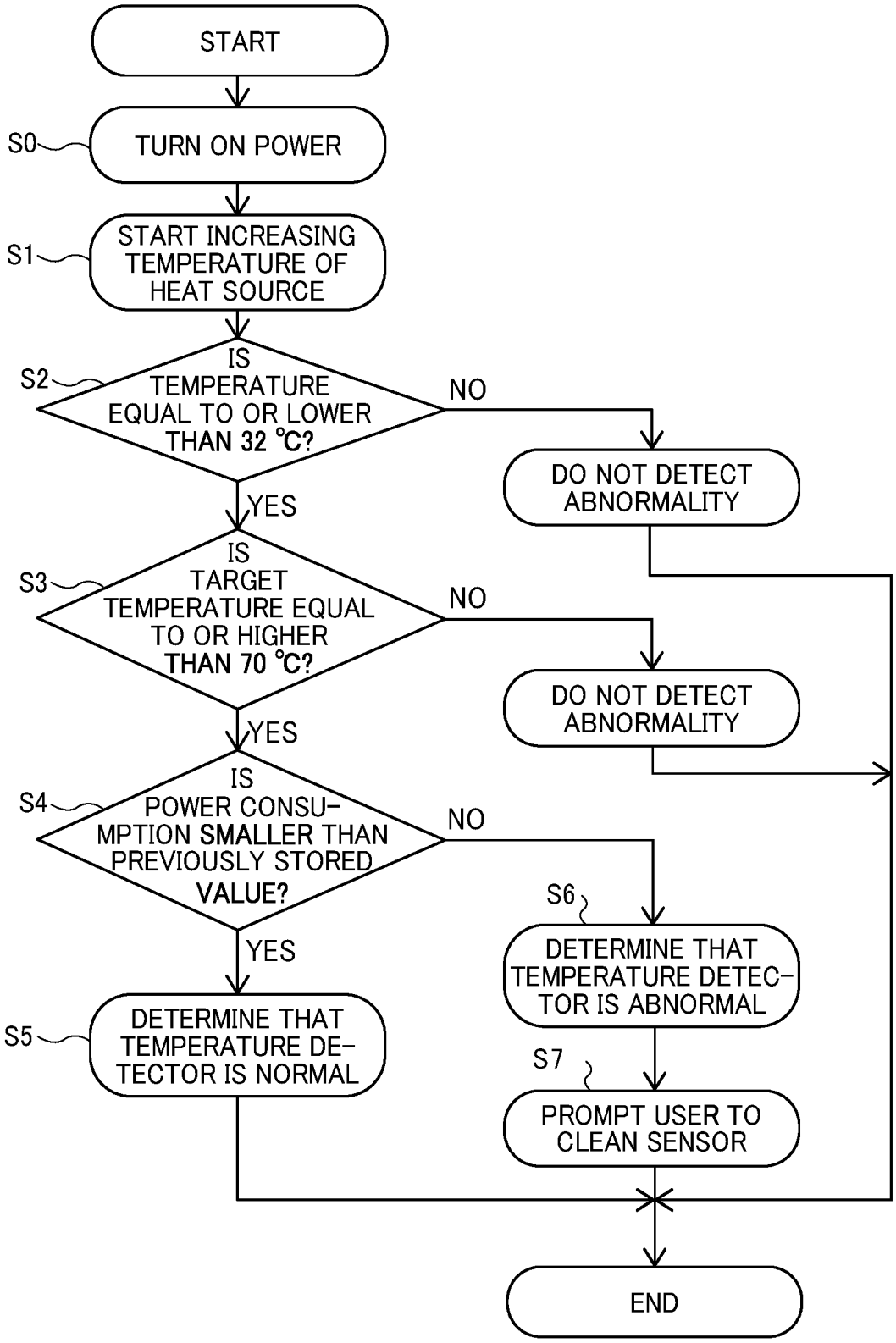
FIG. 10 is a flowchart illustrating an abnormality detection process of the temperature sensor in a first embodiment of the present disclosure.

Next, an abnormality detection process of the temperature sensors 25 according to the first embodiment of the present disclosure is described with reference to a flowchart of FIG. 10.

When a power of the dryer 104 is turned on (or when activation information of the dryer 104 is input from the operation panel including the display 506), the heater lamp 22 (heat source) of the heating roller 11 is turned on, and the controller 300 starts increasing temperature of the heating roller 11 (step S1). Step S0 in FIG. 10 is when the power of the dryer 104 is turned on. Hereinafter, step S1 is simply referred to as "S1."

Thus, the controller 300 controls the abnormality detector 504 to detect the surface temperature of the heating roller 11 with the temperature sensor 25 and determines whether the detected temperature T (start temperature of temperature increase) is equal to or lower than a predetermined temperature (S2). Here, the predetermined temperature is 32° C. At the step S2, if the detected temperature T is not 32° C. or lower (S2, NO), the abnormality detector 504 does not detect abnormality and ends the abnormality detection processes.

Conversely, when the detected temperature T (start temperature of temperature increase) is 32° C. or lower (S2, YES), the abnormality detector 504 determines whether the target temperature for the temperature increase is equal to or higher than 32° C. (S3). Here, the target temperature for the temperature increase is set to 70° C. At the step S3, if the target temperature is not equal to or higher than 70° C. (S3, NO), the abnormality detector 504 ends the abnormality detection process without performing the abnormality detection.

When the surface temperature of the heating roller 11 at a start of temperature increase is 32° C. or lower and the target temperature is equal to or higher than 70° C. corresponding to standby temperature (S3, YES), the abnormality detector 504 determines whether the power consumption is smaller than the previously stored value (S4) to detect an abnormality of the temperature sensor 25.

When the power consumption is smaller than a previously stored value (S4, YES), the abnormality detector 504 determines that the temperature sensor 25 is normal (S5), that is absence of abnormality, and ends the abnormality detection process. The previously stored value is a threshold value to determine an abnormality of the temperature sensor 25.

Conversely, when the power consumption is not smaller than the previously stored value (S4, NO), that is, the power consumption is equal to or larger than the previously stored value (S4, NO), the abnormality detector 504 determines that the temperature sensor 25 is abnormal (S6). Then, the abnormality detector 504 displays information to prompt the user to clean the temperature sensor 25 on the operation panel including the display 506 (S7) and ends the abnormality detection process.

Thus, the abnormality detector 504 detects the abnormality when the detected surface temperature of the heating roller 11 is from an operation temperature of 32° C. or less to the target temperature of 70° C. or more corresponding to the standby temperature.

When the abnormality detector 504 detects the abnormality of the temperature sensor 25, the temperature sensor 25 (temperature detector) detects the surface temperature of the heating roller 11, and the abnormality detector 504 detects time (actual measured value) from time at which the surface temperature of the heating roller 11 reaches to the predetermined temperature (32° C., etc.: first temperature) after start of the temperature increase to time at which the surface temperature of the heating roller 11 reaches to the predetermined surface temperature (for example, 70° C., etc.: second temperature).

At the same time, the power consumption calculator 502 calculates the power consumption (actual measured value) of the heating roller 11 at the time of the detection of the surface temperature of the heating roller 11.

Then, the abnormality detector 504 compares the power consumption (threshold value) of the heating roller 11 determined in advance, when the surface temperature is increased from 32° C. to 70° C., and a calculated value (actual measured value) of the power consumption of the heating roller 11. The power consumption (threshold value) of the heating roller 11 determined in advance corresponds to the surface temperature (actual measured value) of the heating roller 11.

When the temperature sensor 25 is stained (dirty), the temperature sensor 25 detects a low surface temperature (actual measured value) of the heating roller 11 as described above. The temperature sensor 25 detects the lower surface temperature (actual measured value) because the analog output when the lens of the temperature sensor 25 is stained (dirty) is smaller than the analog output when the lens of the temperature sensor 25 is not stained (not dirty). Therefore, the temperature sensor 25 detects temperature of 105° C. (measured value), for example, as 100° C. (read value) when the lens of the temperature sensor 25 is stained (dirty). The temperature of 105° C. is actually higher than the temperature of 100° C., for example, when the lens of the temperature sensor 25 is not stained (not dirty).

Thus, the abnormality detector 504 detects the power consumption of the heating roller 11, when the surface temperature of the heating roller 11 is 105° C., as the actual measured value.

Thus, the abnormality detector 504 compares the power consumption (actual measured value) of the heating roller 11 when the surface temperature is 105° C. and the power consumption (standard value) of the heating roller 11 when the surface temperature is 100° C. Thus, the abnormality detector 504 determines that the power consumption of the actual measured value (105° C.) is larger than the power consumption of the standard value (100° C.) and determines that the temperature sensor 25 is abnormal.

When the abnormality detector 504 determines that there is an abnormality in the temperature sensor 25, the operation panel including the display 506 displays a message prompting the user to clean the temperature sensor 25 as described above. At the time of cleaning the temperature sensor 25, it is preferable to stop the dryer 104 until the abnormality detector 504 detects that the temperature sensor 25 is cleaned.

The temperature sensor 25 according to the present embodiment is not affected by an accumulation of tolerances of the temperature sensors 25. Thus, the abnormality detector 504 can improve an accuracy of abnormality detection (abnormality determination) of the temperature sensor 25 (temperature detector).

Thus, the heating device (dryer 104) includes a heater (heating roller 11) to heat an object to be heated (web 110), a temperature detector (temperature sensor 25) to detect a surface temperature of the heater (heating roller 11), a power calculator (power consumption calculator 502) to calculate a power consumption of the heater (heating roller 11), an abnormality detector 504 to detect an abnormality of the temperature detector (temperature sensor 25), and circuitry (controller 300).

The circuitry (controller 300) causes the heater (heating roller 11) to increase the surface temperature of the heater (heating roller 11) from a first temperature T1 to a second temperature T2 higher than the first temperature T1, causes the power calculator (power consumption calculator 502) to calculate the power consumption of the heater (heating roller 11) increased to the second temperature T2, causes the abnormality detector 504 to compare the power consumption calculated by the power calculator (power consumption calculator 502) and a predetermined threshold value, and causes the abnormality detector 504 to determine that the temperature detector (temperature sensor 25) is abnormal when the power consumption calculated by the power calculator (power consumption calculator 502) is equal to or larger than the predetermined threshold value.

Figure 11:
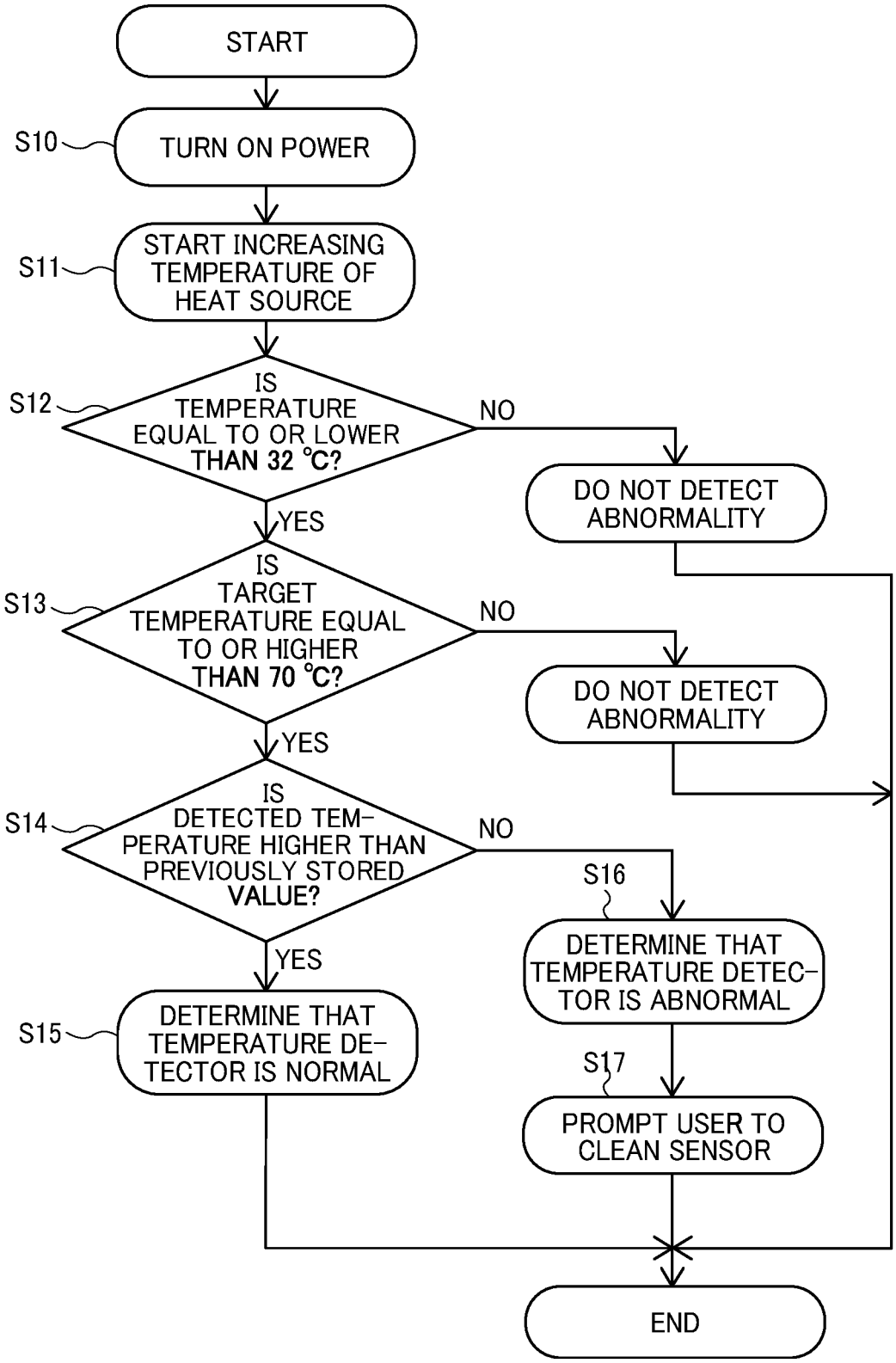
FIG. 11 is a flowchart illustrating an abnormality detection process of the temperature sensor in a second embodiment of the present disclosure.

Next, a second embodiment of the present disclosure is described with reference to FIG. 11. FIG. 11 is a flowchart illustrating an abnormality detection process of the temperature sensor 25 in the second embodiment of the present disclosure.

When a power of the dryer 104 is turned on (or when activation information of the dryer 104 is input from the operation panel including the display 506), the heater lamp 22 (heat source) of the heating roller 11 is turned on, and the controller 300 starts increasing temperature of the heating roller 11 (step S11). Step S10 in FIG. 10 is when the power of the dryer 104 is turned on. Hereinafter, steps S10 and S11 are respectively simply referred to as "S10," and "S11."

Thus, the controller 300 controls the abnormality detector 504 to detect the surface temperature of the heating roller 11 with the temperature sensor 25 and determines whether the detected temperature T (start temperature of temperature increase) is equal to or lower than a predetermined temperature (S12). Here, the predetermined temperature is set to 32° C. At the step S12, if the detected temperature T is not equal to or lower than 32° C. (S12, NO), the abnormality detector 504 does not detect abnormality and ends the abnormality detection processes.

Conversely, when the detected temperature T (start temperature of temperature increase) is equal to or lower than 32° C. (S12, YES), the abnormality detector 504 determines whether the target temperature for the temperature increase is equal to or higher than 32° C. (S3). At S13, if the target temperature is not equal to or higher than 70° C. (S13, NO), the abnormality detector 504 ends the abnormality detection process without performing the abnormality detection.

When the surface temperature of the heating roller 11 at a start of temperature increase is equal to or lower than 32° C. and the target temperature is equal to or higher than 70° C. corresponding to standby temperature (S13, YES), the abnormality detector 504 determines whether the detected temperature is higher than the previously stored value (S14) to detect an absence and a presence of the abnormality of the temperature sensor 25.

When the detected temperature is higher than a previously stored value (S14, YES), the abnormality detector 504 determines that the temperature sensor 25 is normal (S15), that is absence of abnormality, and ends the abnormality detection process.

Conversely, when the detected temperature is not higher than the previously stored value, that is equal to or lower than the previously stored value (S14, NO), the abnormality detector 504 determines that the temperature sensor 25 is abnormal (S16). Then, the abnormality detector 504 displays information to prompt the user to clean the temperature sensor 25 on the operation panel including the display 506 (S17) and ends the abnormality detection process.

Thus, the abnormality detector 504 detects the abnormality when the detected surface temperature of the heating roller 11 is increased from the surface temperature equal to or less than an operation temperature of 32° C. to the surface temperature equal to or higher than the target temperature of 70° C. corresponding to the standby temperature.

The abnormality detector 504 detects the surface temperature of the heating roller 11 with the temperature sensor 25 to detect the abnormality in the temperature sensor 25. Further, the controller 300 applies an electric power to the heating rollers 11 to increase the surface temperature of the heating roller 11 so that the surface temperature of the heating roller 11 reaches a predetermined surface temperature (for example, 70° C.: second temperature) after the surface temperature of the heating roller 11 reaches a predetermined temperature (for example, 32° C.: first temperature) by start increasing the surface temperature of the heating roller 11. Then, the abnormality detector 504 detects the surface temperature (actual measured value) of the heating roller 11 at time of application of the power with the temperature sensor 25.

Then, the abnormality detector 504 compares the surface temperature (second temperature, threshold value) of the heating roller 11 and the surface temperature (actual measured value) of the heating roller 11.

When the temperature sensor 25 is stained (dirty), the temperature sensor 25 detects a low surface temperature (actual measured value) of the heating roller 11 as described above. The temperature sensor 25 detects the lower surface temperature (actual measured value) because the analog output when the lens of the temperature sensor 25 is stained (dirty) is lower than the analog output when the lens of the temperature sensor 25 is not stained (not dirty). Therefore, the temperature sensor 25 detects temperature of 105° C. (measured value), for example, as 100° C. (read value) when the lens of the temperature sensor 25 is stained (dirty). The temperature of 105° C. is actually higher than the temperature of 100° C., for example, when the lens of the temperature sensor 25 is not stained (not dirty).

Thus, the temperature sensor 25 detects a value of lower than 100° C. as the actual measured value even if the surface temperature of the heating roller 11 corresponding to the power consumption of the heating roller 11 actually reaches the second temperature of 100° C. that is a read value when the temperature sensor 25 is not stained (dirty).

Thus, the abnormality detector 504 compares the surface temperature (second temperature) of the heating roller 11 and the surface temperature (actual measured value) of the heating roller 11 that is detected to be lower than 100° C. Thus, the abnormality detector 504 determines that the actual measured value is lower than the second temperature and determines that the temperature sensor 25 is abnormal.

When the abnormality detector 504 determines that there is an abnormality in the temperature sensor 25, the operation panel including the display 506 displays a message prompting the user to clean the temperature sensor 25 as described above. At the time of cleaning the temperature sensor 25, it is preferable to stop the dryer 104 until the abnormality detector 504 detects that the temperature sensor 25 is cleaned.

The abnormality detector 504 according to the second embodiment is not affected by the accumulation of tolerances of the temperature sensors 25. Thus, the abnormality detector 504 can improve the accuracy of abnormality detection (abnormality determination) of the temperature sensor 25 (temperature detector).

Thus, a heating device (dryer 104) includes a heater (heating roller 11) to heat an object to be heated (web 110), a temperature detector (temperature sensor 25) to detect a surface temperature of the heater (heating roller 11), a power calculator (power consumption calculator 502) to calculate a power consumption of the heater (heating roller 11), an abnormality detector 504 to detect an abnormality of the temperature detector (temperature sensor 25), and circuitry (controller 300).

The circuitry (controller 300) applies a predetermined power to the heater (heating roller 11) to cause the heater (heating roller 11) to increase the surface temperature of the heater (heating roller 11) from a first temperature T1 to a second temperature T2 higher than the first temperature T1, cause the temperature detector (temperature sensor 25) to detect the surface temperature of the heater (heating roller 11) increased to the second temperature T2, cause the abnormality detector 504 to compare the surface temperature of the heater (heating roller 11) detected by the temperature detector (temperature sensor 25) with the second temperature T2, and cause the abnormality detector 504 to determine that the temperature detector (temperature sensor 25) is abnormal when the surface temperature of the heater (heating roller 11) detected by the temperature detector (temperature sensor 25) is equal to or lower than the second temperature T2.

Figure 12:
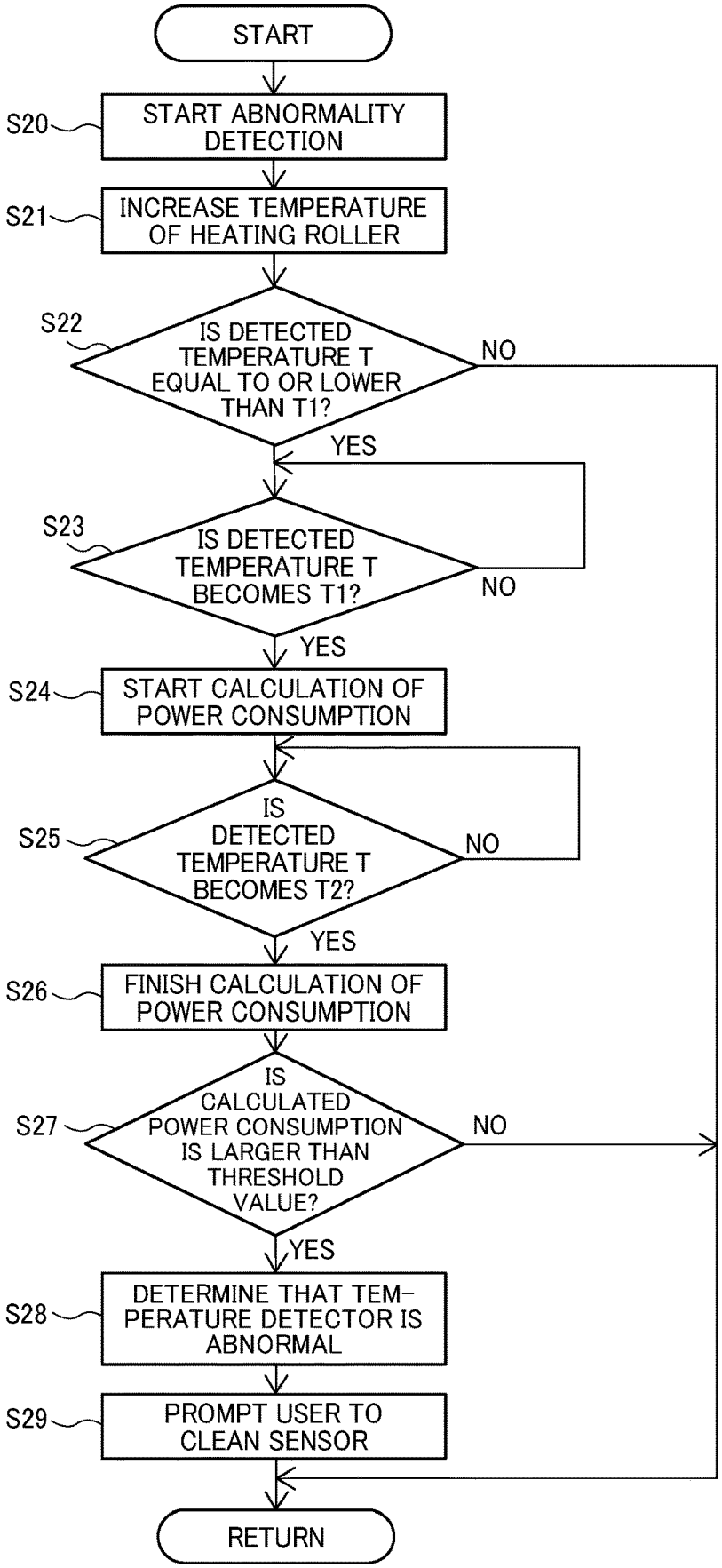
FIG. 12 is a flowchart illustrating an abnormality detection process of the temperature sensor in a third embodiment of the present disclosure.

Next, an abnormality detection process of the temperature sensors 25 according to a third embodiment of the present disclosure is described with reference to a flowchart of FIG. 12.

When a power of the dryer 104 is turned on (or when activation information of the dryer 104 is input from the operation panel including the display 506), the heater lamp 22 (heat source) of the heating roller 11 is turned on, and the controller 300 starts increasing a temperature of the heating roller 11 (step S21). Step S20 in FIG. 12 is when the power of the dryer 104 is turned on. Hereinafter, steps S20 and S21 are respectively simply referred to as "S20," and "S21."

Then, the abnormality detector 504 determined whether the temperature T detected by the temperature sensor 25 is equal to or lower than a predetermined first temperature T1 (S22). The abnormality detector 504 in the third embodiment compares the detected temperature T, when the surface temperature of the heating roller 11 is raised from the first temperature T1 to the second temperature T2 higher than the first temperature T1, and a calculated value of the power consumption to detect abnormality of the temperature sensor 25. Therefore, when the detected temperature T is higher than the first temperature T1 (S22, NO), the abnormality detector 504 ends the abnormality detection process without performing the abnormality detection.

Then, when the detected temperature T by the temperature sensor 25 is equal to or lower than the predetermined first temperature T1 (S22, YES), the abnormality detector 504 determines whether the detected temperature T becomes the first temperature T1 (S23). When the detected temperature T becomes the first temperature T1 (S23, YES), the abnormality detector 504 starts calculation of the power consumption (S24).

Next, the abnormality detector 504 determines whether the detected temperature T becomes the second temperature T2 (S25). When the detected temperature T becomes the second temperature T2 (S25, YES), the abnormality detector 504 finishes calculation of the power consumption (S26).

Then, the abnormality detector 504 determines whether the calculated value of the power consumption is larger than a predetermined threshold value of the power consumption (calculated value>threshold value) when the surface temperature increases from the first temperature T1 to the second temperature T2 (S27). The threshold value may be a value that allows a predetermined temperature error, for example.

When the calculated value of the power consumption is not larger than (equal to or less than) the threshold value (S27, NO), the abnormality detector determines that no abnormality exists in the temperature sensor 25 (temperature sensor 25 is normal). Thus, the abnormality detector 504 ends the abnormality detection process.

Conversely, when the calculated value of the power consumption is larger than the threshold value (S27, YES), an error exceeds an allowable range occurs in the detected temperature T of the temperature sensor 25. Thus, the abnormality detector 504 determines that the temperature sensor 25 as the temperature detector is abnormal (S28). Then, the abnormality detector 504 controls the display 506 to display an output to prompt the user to clean the temperature sensor 25 (S29).

Thus, the abnormality detector 504 is not affected by the accumulation of tolerances of the temperature sensors 25. Thus, the abnormality detector 504 can improve the accuracy of abnormality detection (abnormality determination) of the temperature sensor 25.

Figure 13:
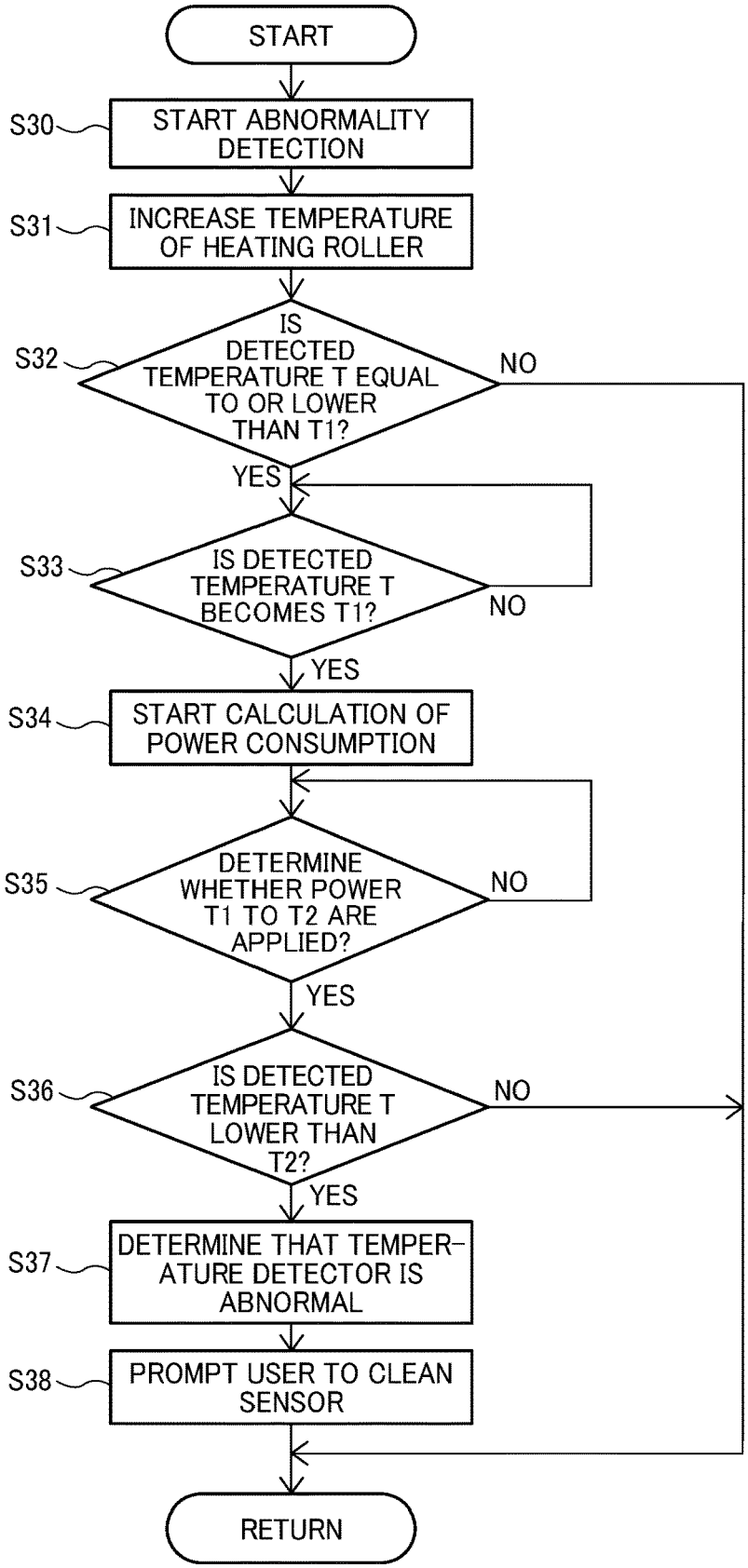
FIG. 13 is a flowchart illustrating an abnormality detection process of the temperature sensor in a fourth embodiment of the present disclosure.

Next, an abnormality detection process of the temperature sensors 25 according to a fourth embodiment of the present disclosure is described with reference to a flowchart of FIG. 13.

When a power of the dryer 104 is turned on (or when activation information of the dryer 104 is input from the operation panel including the display 506), the heater lamp 22 (heat source) of the heating roller 11 is turned on, and the controller 300 start increasing a temperature of the heating roller 11 (step S31). Step S30 in FIG. 13 is when the power of the dryer 104 is turned on. Hereinafter, steps S30 and S31 are respectively simply referred to as "S30," and "S31."

Then, the abnormality detector 504 determined whether the detected temperature T by the temperature sensor 25 is equal to or lower than the predetermined first temperature T1 (S32). The abnormality detector 504 in the fourth embodiment compares the detected temperature T, when the surface temperature of the heating roller 11 is raised from the first temperature T1 to the second temperature T2 higher than the first temperature T1, and a calculated value of the power consumption to detect abnormality of the temperature sensor 25. Therefore, when the detected temperature T is higher than the first temperature T1 (S32, NO), the abnormality detector 504 ends the abnormality detection process without performing the abnormality detection.

Then, when the detected temperature T by the temperature sensor 25 is equal to or lower than the predetermined first temperature T1 (S32, YES), the abnormality detector 504 determines whether the detected temperature T becomes the first temperature T1 (S33). When the detected temperature T becomes the first temperature T1 (S33, YES), the abnormality detector 504 starts calculation of the power consumption (S34).

Then, the abnormality detector 504 determines whether a power (power consumption), that increases the surface temperature of the heating roller 11 from the first temperature T1 to the second temperature T2, is applied to the heater lamp 22 (heat source) of the heating roller 11 based on the calculated value of the power consumption (S35).

Then, when the power (power consumption) that increases the surface temperature of the heating roller 11 from the first temperature T1 to the second temperature T2 is applied to the heater lamp 22 (heat source) (S35, YES), the abnormality detector 504 determines whether the detected temperature T is lower than the second temperature T2 (S36).

When the detected temperature T is equal to or higher than the second temperature T2 (S36, NO), the abnormality detector 504 determines that no abnormality exists in the temperature sensor 25 and ends the abnormality detection process.

Conversely, when the detected temperature T is lower than the second temperature T2 (S36, YES), the error exceeds an allowable range occurs in the detected temperature T of the temperature sensor 25. Thus, the abnormality detector 504 determines that the temperature sensor 25 as the temperature detector is abnormal (S37). Then, the abnormality detector 504 controls the display 506 to display an output to prompt the user to clean the temperature sensor 25 (S38).

Thus, the abnormality detector 504 is not affected by the accumulation of tolerances of the temperature sensors 25. Thus, the abnormality detector 504 can improve the accuracy of abnormality detection (abnormality determination) of the temperature sensor 25.

A fifth embodiment of the present disclosure is described with reference to FIGS. 14 and 15. FIG. 14 is a table illustrating the fifth embodiment of the present disclosure. FIG. 15 is a table illustrating an example of a comparison determination used for describing an effect of the fifth embodiment.

The dryer 104 stores a relation between the power consumption and a characteristic value of the temperature sensor 25 in a device such as the abnormality detector 504 in advance at time of factory assembly or new installation of the printer by service person. As illustrated in FIG. 14, the table is used to store the relation between the power consumption and a characteristic value of the temperature sensor 25. Specifically, the table stores a deviation amount (%), that is a difference between the standard value of the power consumption (power standard) of a predetermined one heating roller 11 (heating roller 11A, for example) and the power consumption of each of other heating rollers 11. Thus, the table stores the deviation amount of each of other heating rollers 11.

Further, the detected temperature detected by the temperature sensor 25A serving as a predetermined one temperature detector among two temperature sensors 25A and 25B in each of the heating rollers 11, for example, is used as a standard value. The deviation amount (° C.) that is a difference between the detected temperature by another temperature sensor 25B and the standard value of the detected temperature of the temperature sensor 25A is stored in the table illustrated in FIG. 14.

It is preferable to set the heating roller 11A as a standard heating roller 11. The web 110 first comes into contact with the heating roller 11A among the heating rollers 11 in the dryer 104.

A main reason of stain (dirt) on the lens of the thermopile sensor configuring the temperature sensor 25 is attachment of a solvent evaporated during drying of ink to a surface of the lens of the temperature sensor 25.

In a configuration in which the web 110 is heated by the plurality of heating rollers 11, the temperature of the web 110 and the ink when contacting the heating roller 11A first is lower than the temperature of the web 110 and the ink when contacting other heating rollers 11. Thus, evaporation of the solvent in the ink when the web 110 contacts the heating roller 11A is small, and the lens of the temperature sensor 25 of the heating roller 11A is unlikely to be stained (dirty).

In the above described embodiments, the printer 500 has a configuration in which one heating roller 11 contacts the web 110 twice. Thus, the heating roller 11A that contacts the web 110 first becomes the heating roller 11 that contacts the web 110 last in a second contact with the web 110. When the web 110 contacts the heating roller 11A for a second time, the solvent in the ink on the web 110 has evaporated to some extent, so that the lens of the temperature sensor 25 is unlikely to be stained (dirty).

It should be noted that other causes that stain the lens of the temperature sensor 25 include paper dust and other dust. However, the paper dust and other dust has no particular superiority on an arrangement position of the heating roller 11.

Further, since there is no particular superiority with respect to the standard of the plurality of temperature sensors 25 (temperature detector). Thus, any of the plurality of temperature sensors 25 may be used if the plurality of temperature sensors 25 are installed in the same heating roller 11.

The abnormality detector 504 in the fifth embodiment determines that the temperature sensors 25 of other heating rollers 11B to 11J are abnormal when the difference between the power consumption of predetermined one heating roller 11A (standard value of the power consumption) and the power consumption of each of the plurality of heating rollers 11B to 11J is equal to or larger than a threshold value (for example, 5%).

Further, the abnormality detector 504 in the fifth embodiment determines that the temperature sensors 25B is abnormal when the difference between the detected temperature of predetermined one temperature sensor 25A and the detected temperature of another temperature sensor 25B is equal to or larger than a threshold value (for example, 5° C.).

For example, when the temperature of the heating roller 11 is increased to use the dryer 104, the dryer 104 acquires the power consumption and the surface temperature for each heating roller 11. Then, the abnormality detector 504 compares the acquired power consumption and surface temperature with the information previously stored in the table illustrated in FIG. 14. The abnormality detector 504 determines that the temperature sensor 25 corresponding to the heating roller 11 having a large deviation amount of power consumption and surface temperature is abnormal based on the above-described comparison.

For example, as illustrated in FIG. 15, according to a measurement result of the power consumption, the difference between the standard value of the power consumption of the heating roller 11A and the measurement result of the power consumption of the heating roller 11J is 7% (−2% to 5%). Since the threshold (allowable value) of the difference is set to 5%, the abnormality detector 504 determines that the heating roller 11J, the difference of which is 7%, is abnormal.

Further, as illustrated in FIG. 15, the temperature sensor 25B of the heating roller 11J is deviated from the temperature sensor 25A by 9° C. (1° C. to 10° C.). Since the threshold (allowable value) of the difference is set to 5%, the abnormality detector 504 determines that the heating roller 11J, the difference of which is 7%, is abnormal.

In the above-described case, the dryer 104 controls the surface temperatures of the heating rollers 11 while the temperature sensor 25A of the heating roller 11J detects the surface temperature of the heating roller 11J to be 9° C. lower than the standard value of the detected temperature of the heating roller 11A. Thus, the detected value of the surface temperature of the temperature sensor 25B that detects the heating roller 11J increases.

In the fifth embodiment, the temperature sensor 25 of the heating roller 11J is easily stained (dirty) because a large amount of the solvent evaporated during drying of ink tends to float due to heating condition of the web 110 before reaching the heating drum 12 and heat applied to the web 110 by the heating drum 12 having a long contact distance.

The dryer 104 according to the fifth embodiment can detect which of the contactless temperature detector (temperature sensor 25) in which of the heating roller 11 is abnormal. Since the dryer 104 previously stores the data of the power consumption and the temperature using the device, the dryer 104 can detect abnormality without being affected by component variations and voltage fluctuations.

When the temperature sensor 25 (contactless temperature detector) of the heating roller 11A as the standard heating roller 11 is stained (dirty), the power consumption of the standard heating roller 11A (power standard) becomes smaller than each of the power consumption of the heating rollers 11B to 11J. Thus, the abnormality detector 504 can determine that the standard heating roller 11A is abnormal.

Therefore, a heating device (dryer 104) includes a plurality of heaters (heating rollers 11) to heat an object to be heated (web 110), a plurality of temperature detectors (temperature sensors 25) to detects surface temperatures of the plurality of heaters (heating roller 11), a power calculator (power consumption calculators 502) to calculate a power consumption of each of the plurality of heaters (heating rollers 11), and an abnormality detector 504 to detect an abnormality of each of the plurality of temperature detectors (temperature sensors 25).

The abnormality detector 504 calculate a difference between the power consumption of one of the plurality of heaters (heating rollers 11) determined in advance and the power consumption of another of the plurality of heaters (heating rollers 11), compares the difference calculated by the abnormality detector 504 with a threshold value, and determines that one of the plurality of temperature detectors (temperature sensors 25) that detects the surface temperature of said another of the plurality of heaters (heating rollers 11) is abnormal when the difference is equal to or larger than the threshold vale.

Each of the above-described embodiments describes an example in which the heating roller 11 (heater) according to the present embodiments are applied to the dryer 104. However, the heating roller 11 (heater) according to the present embodiments may also be applied to a heater or a conveyor that includes a rotator such as a drive roller that applies conveyance force to the heater and a sheet.

Each of the above-described embodiments described examples in which the web is a continuous sheet. However, the web is not limited to the continuous sheet. For example, the web may be a continuous body such as continuous paper, roll paper, a recording medium (object to be printed) such as long sheet material, wallpaper, sheet for electronic circuit board, or the like.

The printer may print recording images such as characters and figures with a liquid such as ink on a web. Further, the printer may print an arbitrary image such as a pattern on the web with a liquid such as ink on the web for decoration.

Herein, the liquid to be applied to a web is not particularly limited, but it is preferable that the liquid has a viscosity of less than or equal to 30 mPa·s under a normal temperature and a normal pressure or by being heated or cooled.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as a liquid application device, examples of an energy generation source to discharge a liquid include an energy generation source using a piezoelectric actuator (a lamination piezoelectric element and a thin-film piezoelectric element), a thermal actuator using an electrothermal transducer element such as a heating resistor, a static actuator including a diaphragm plate and opposed electrodes, and the like.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the controller 300 as described above may be implemented by one or more processing circuits or circuitry.

The terms "printing" in the present embodiment may be used synonymously with the terms of "image formation", "recording", "printing", and "image printing".

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating device comprising:

a heater configured to heat an object to be heated;

a temperature detector configured to detect a surface temperature of the heater;

a power calculator configured to calculate a power consumption of the heater;

an abnormality detector configured to detect an abnormality of the temperature detector; and circuitry configured to:

cause the heater to increase the surface temperature of the heater from a first temperature to a second temperature higher than the first temperature;

cause the power calculator to calculate the power consumption of the heater increased to the second temperature;

cause the abnormality detector to compare the power consumption calculated by the power calculator and a predetermined threshold value; and cause the abnormality detector to determine that the temperature detector is abnormal when the power consumption calculated by the power calculator is equal to or larger than the predetermined threshold value.

2. The heating device according to claim 1, wherein the power calculator multiplies time and a current value applied to the heater, while the circuitry increases the surface temperature of the heater, to calculate the power consumption of the heater.

3. The heating device according to claim 1, wherein the power calculator multiplies time and an effective power applied to the heater, while the circuitry increases the surface temperature of the heater, to calculate the power consumption of the heater.

4. The heating device according to claim 1, wherein the temperature detector detects the surface temperature of the heater in a contactless manner.

5. The heating device according to claim 1, wherein the abnormality detector outputs information related to an abnormality of the temperature detector.

6. A printer comprising:

a liquid application device configured to apply a liquid on an object to be printed; and the heating device according to claim 1, the heating device configured to dry the liquid on the object to be printed.

* * * * *